US005874148A

United States Patent [19]

Hough et al.

[11] Patent Number: 5,874,148

[45] Date of Patent: Feb. 23, 1999

[54] WATER RESISTANT TEXTILE COATING AND METHOD OF USING THE SAME

[75] Inventors: J. Garry Hough, Fuquay-Varina; W. Scott Rutherford, Chapel Hill; Michael Smith, Concord, all of N.C.

[73] Assignee: Reichhold Chemicals, Inc., Durham, N.C.

[21] Appl. No.: 839,878

[22] Filed: Apr. 21, 1997

[51] Int. Cl.[6] ..... B32B 3/02; C08K 3/10; B05D 3/02

[52] U.S. Cl. ..... 428/95; 442/79; 442/84; 442/85; 442/90; 524/413; 427/372.2

[58] Field of Search ..... 428/95; 442/79, 442/84, 85, 90; 524/413; 427/372.2

[56] References Cited

U.S. PATENT DOCUMENTS

| | | | |
|---|---|---|---|
| Re. 34,951 | 5/1995 | Slosberg et al. | 428/95 |
| 3,695,987 | 10/1972 | Wisotzky et al. | 161/67 |
| 3,728,182 | 4/1973 | Wisotzky et al. | 156/72 |
| 3,823,056 | 7/1974 | Cooney | 161/67 |
| 3,887,738 | 6/1975 | Taft et al. | 428/95 |
| 3,931,085 | 1/1976 | Drelich et al. | 260/29.6 |
| 4,012,546 | 3/1977 | Schwartz et al. | 428/95 |
| 4,012,547 | 3/1977 | Smedberg | 428/97 |
| 4,097,430 | 6/1978 | Phillips | 524/43 |
| 4,112,161 | 9/1978 | Sorrells | 428/95 |
| 4,185,135 | 1/1980 | Huff | 428/96 |
| 4,216,130 | 8/1980 | Rigge et al. | 260/29.7 |
| 4,239,563 | 12/1980 | Iacoviello | 156/72 |
| 4,444,831 | 4/1984 | Leitner | 428/262 |
| 4,447,570 | 5/1984 | Cook et al. | 524/127 |
| 4,566,980 | 1/1986 | Smith | 252/8.6 |
| 4,579,762 | 4/1986 | Ucci | 428/95 |
| 4,595,617 | 6/1986 | Bogdany | 428/95 |
| 4,643,930 | 2/1987 | Ucci | 428/96 |
| 4,673,616 | 6/1987 | Goodwin | 428/289 |
| 4,721,748 | 1/1988 | Iovine et al. | 524/460 |
| 4,824,709 | 4/1989 | Tschirch | 428/95 |
| 4,857,566 | 8/1989 | Helbling | 523/409 |
| 4,972,018 | 11/1990 | Leadbetter | 524/47 |
| 5,122,404 | 6/1992 | Fowler | 428/87 |
| 5,213,866 | 5/1993 | Swope et al. | 428/95 |
| 5,348,785 | 9/1994 | Vinod | 428/95 |
| 5,378,755 | 1/1995 | Krishnan et al. | 524/555 |
| 5,445,860 | 8/1995 | Bova | 428/87 |
| 5,478,881 | 12/1995 | Wilkerson, III et al. | 524/555 |
| 5,532,036 | 7/1996 | Wilkerson, III et al. | 428/96 |

FOREIGN PATENT DOCUMENTS

| | | | |
|---|---|---|---|
| 1 122 848 | 8/1968 | United Kingdom | B44D 1/00 |

*Primary Examiner*—Terrel Morris
*Attorney, Agent, or Firm*—Myers Bigel Sibley & Sajovec, P.A.

[57] ABSTRACT

A textile coating composition comprises a resin dispersed in an aqueous medium, a wax, and a polyvalent metal complex compound. An article of manufacture comprises a textile substrate and the coating which is carried by the textile substrate. A method of preparing a textile substrate comprises applying to a surface of the textile substrate the coating composition, and then heating the surface of the textile substrate to dry the coating composition.

42 Claims, No Drawings

WATER RESISTANT TEXTILE COATING AND METHOD OF USING THE SAME

FIELD AND BACKGROUND OF THE INVENTION

The present invention relates to a water resistant coatings for textile substrates and its method of use.

The term "extile substrates" as used herein relates to a fiber, web, yarn, thread, sliver, woven fabric, knitted fabric, non-woven fabric, upholstery fabric, tufted carpet, pile carpet, etc. formed from natural or synthetic fibers or both. Such textile substrates are susceptible to water damage caused by the substrate coming into contact (e.g., via spill) with water or other liquids, (e.g., coffee, urine, soda pop, etc.). The textile substrates are also vulnerable to staining and leaching of components out of the fibers making up the substrate.

For example, a typical residential carpet comprises a primary backing material (e.g., polypropylene or jute) having pile yarns extending from the front of the primary backing to form pile tufts and a secondary backing. Water or stain-producing compositions, particularly liquids, contact the facing or secondary backing, and are often absorbed by the secondary backing. Drying can remove the water, but this is typically a slow process. Moreover, while the carpet is wet, mildew and rotting of the textile substrate and the underlying floor can occur. Additionally, undesirable odors such as from urine can become trapped by the substrate. The liquid may also stain the components of the substrate.

In view of the above, efforts have focused on attempts to provide carpets which are resistant to soiling and are substantially impervious to water and other liquids as set forth in U.S. Pat. Nos. 4,643,930; and 4,579,762 to Ucci; and 5,348,785 to Vinod. These patents however teach the use of halogen-based components, more specifically fluorochemicals, in the tuft-lock coating in addressing the above problems. The use of such materials is potentially disadvantageous in that they may be environmentally hazardous. Moreover, these materials are often expensive, and may function poorly in being impervious to hot liquids.

There is a need in the art to provide textile coatings and articles of manufacture which utilize coating compositions which are substantially soil and water resistant and do not utilize fluorochemicals.

SUMMERY OF THE INVENTION

To the above end and others, it is an object of the present invention to provide textile coatings and articles of manufacture which contain the same which are substantially water resistant and do not utilize fluorochemicals.

In one embodiment, the invention relates to an article of manufacture comprising a textile substrate and a coating composition carried by the textile substrate. The coating comprising comprises a resin dispersed in an aqueous medium, a wax, and a polyvalent metal complex compound.

In another embodiment, the invention provides a pile carpet which comprises a primary backing having a front face and a rear face; pile yarns extending through the front face of the primary backing to form pile tufts, and having portions extending through the primary backing. A tuft-lock coating having improved soil and water resistance is carried by the rear face of the primary backing and securing the pile yarns to the primary backing. The tuft-lock coating comprises a resin dispersed in an aqueous medium, a wax, and a polyvalent metal complex compound.

In still another embodiment, the present invention provides a method of preparing a textile substrate having improved soil and water resistance. The method comprises applying to a surface of the textile substrate a coating composition which comprises a resin, a wax, and a polyvalent metal complex compound. The surface of the textile substrate is then heated to dry the coating composition.

DETAILED DESCRIPTION OF THE INVENTION

The present invention now will be described more fully hereinafter with reference to the specification, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

As summarized above, the present invention relates to an article of manufacture comprising a textile substrate and a coating composition carried by the substrate. The coating composition includes a resin dispersed in an aqueous medium, a wax, and a polyvalent metal complex compound.

Various resin materials may be used in the coating composition of the invention. Exemplary resins are described in U.S. Pat. Nos. 3,505,156; 3,695,987; 4,595,617; 4,808,459; and 5,505,999, the disclosures of which are incorporated by reference herein in their entirety. In one embodiment, the resin is a copolymer formed from an aryl vinyl monomer and an aliphatic conjugated diene monomer. Suitable aryl vinyl monomers which may be employed include, for example, styrene and styrene derivatives such as alpha-methyl styrene, p-methyl styrene, vinyl toluene, ethylstyrene, tert-butyl styrene, monochlorostyrene, dichlorostyrene, vinyl benzyl chloride, fluorostyrene, alkoxystyrenes (e.g., paramethoxystyrene), and the like. Blends and mixtures of the above may also be used. The aryl vinyl monomer, for example, may be used in an amount, based on the total weight of the starting monomers, preferably from about 35 to 70 percent by weight, more preferably from about 45 to 70 percent by weight, and most preferably from about 55 to 65 percent by weight. A particularly preferred aryl vinyl monomer is styrene.

Suitable aliphatic conjugated dienes are $C_4$ to $C_9$ dienes and include, for example, butadiene monomers such as 1,3-butadiene, 2-methyl-1,3-butadiene, 2 chloro-1,3-butadiene, and the like. Blends or copolymers of the diene monomers can also be used. The aliphatic conjugated diene may be used in an amount, based on the total weight of the starting monomers, preferably from about 25 to 65 percent by weight, more preferably from about 30 to 55 percent by weight, and most preferably from about 35 to 45 percent by weight. A particularly preferred aliphatic conjugated diene is 1,3-butadiene.

The coating composition may also include an acrylamide-based monomer. Exemplary acrylamide-based monomers which may be employed include, for example, acrylamide, N-methyol-methacrylamide, N-methyolacrylamide, methacrylamide, N-isopropylacrylamide, N-tert-butylacrylamide, N-N'-methylene-bis-acrylamide, alkylated N-methylolacrylamides such as N-methoxymethylacrylamide and N-butoxymethylacrylamide, and blends and mixtures thereof. The acrylamide-based monomer may serve a variety of functions, for example, the acrylamide-based monomers may be function as crosslinking agents, e.g., self crosslinking monomers. The acrylamide-based monomer may be used in an amount, based on the total weight of the starting monomers, preferably from about 0.2 to 10 percent by weight, and more preferably from about 0.5 to 5 percent by weight.

The coating composition may also include a non-aromatic unsaturated monocarboxylic ester monomer. Suitable non-aromatic unsaturated monocarboxylic ester monomers include, for example, acrylates and methacrylates. The acrylates and methacrylates may include functional groups such as amino groups, hydroxy groups, epoxy groups and the like. Exemplary acrylates and methacrylates include methyl acrylate, methyl methacrylate, ethyl acrylate, ethyl methacrylate, butyl acrylate, butyl methacrylate, 2-ethylhexyl acrylate, glycidyl acrylate, glycidyl methacrylate, hydroxyethyl acrylate, hydroxyethyl methacrylate, hydroxypropyl acrylate, hydroxypropyl methacrylate, isobutyl methacrylate, hydroxybutyl acrylate, hydroxybutyl methacrylate, 3 -chloro-2-hydroxybutyl methacrylate, n-propyl methacrylate and the like. Exemplary amino-functional methacrylates include t-butylamino ethyl methacrylate and dimethylamino ethyl methacrylate. Suitable non-aromatic dicarboxylic ester monomers are alkyl and dialkyl fumarates, itaconates and maleates, with the alkyl group having one to eight carbons, with or without functional groups. Specific monomers include diethyl and dimethyl fumarates, itaconates and maleates. Other suitable non-aromatic dicarboxylic ester monomers include di(ethylene glycol) maleate, di(ethylene glycol) itaconate, bis(2-hydroxyethyl) maleate, 2-hydroxyethyl methyl fumarate, and the like. The non-aromatic unsaturated mono- or dicarboxylic ester monomer may be used in any appropriate amount for the purposes of the invention. Preferably, the monomer is used from about 1 to about 10 percent based on the total weight of the starting monomers. A particularly preferred non-aromatic unsaturated monocarboxylic ester monomer is methyl methacrylate.

Suitable monomers based on the half ester of the unsaturated dicarboxylic acid monomer may also be used in the coating composition and include mono esters of maleic acid or fumaric acid having the formula ROOC—CH═CH—COOH wherein R is a $C_1$ to $C_{12}$ alkyl group, for example monomethyl maleate, monobutyl maleate and monooctyl maleate. Half esters of itaconic acid having $C_1$ to $C_{12}$ alkyl groups such as monomethyl itaconate can also be used. Blends or copolymers of the unsaturated mono- or dicarboxylic acid monomers and of the half ester of the unsaturated dicarboxylic acid can also be used. The unsaturated mono- or dicarboxylic acid or monomer based on the half ester of the unsaturated dicarboxylic acid is used in an amount, based on the total weight of the starting monomers, from about 0.2 to about 10 percent by weight, and more preferably from about 0.5 to about 5 percent by weight.

Unsaturated mono- or dicarboxylic acid monomers and derivatives thereof may also be employed in the coating composition and include components such as acrylic acid, methacrylic acid, itaconic acid, fumaric acid, and maleic acid, and the like. The unsaturated mono- or dicarboxylic acid monomers and derivatives thereof may be used in an amount, based on the total weight of the starting monomers, from about 0.2 to about 5 percent by weight.

Additional comonomers can be added to the latex polymer. Included among such comonomers are monoethylenically unsaturated substituted aliphatic hydrocarbons such as vinyl chloride, and vinylidene chloride; aliphatic vinyl esters such as vinyl formate, vinyl propionate and vinyl butyrate. Acrylonitrile may also be employed.

The wax component which is employed in the coating composition may include any number of components which are typically found in wax materials. For the purposes of the invention, "wax" is to be generally defined as a low-melting organic mixture or compound of high molecular weight. Wax is typically similar in composition to fats and oils except that it does not contain glycerides. Wax may be formed from hydrocarbons, esters of fatty acids and alcohols, and mixtures of the above. Waxes used in the invention may include, but are not limited to, natural components derived from various sources such as, for example, animal (e.g., beeswax, lanolin, shellac wax, Chinese insect wax, and the like); vegetable (e.g., carnauba, candelilla, bayberry, sugar cane, and the like); and mineral such as fossil or earth waxes (e.g., ozocerite, ceresin, montan, and the like) or petroleum waxes (e.g., paraffin, microcrystalline, and the like). Synthetic waxes may also be used such as, for example, ethylene polymers and polyol ether-esters (e.g., Carbowax™, sorbitol, and the like); chlorinated naphthalenes (e.g., Halowax™, and the like); and hydrocarbon types such as those derived from Fischer-Tropsch synthesis. Mixtures of any of the above waxes may be used. The preferred wax used in the coating composition of the invention is formed from petroleum waxes. The coating composition preferably comprises from about 1 to about 50 percent of wax based on the total monomer weight, more preferably from about 2 to about 30 weight percent of wax, and most preferably from about 5 to about 15 weight percent of wax.

The coating composition also includes a polyvalent metal complex compound. Exemplary compounds of this type are described in U.S. Pat. Nos. 3,931,085 to Drelich et al.; 4,447,570 to Cook et al.; and 4,097,430 to Phillips, the disclosures of which are incorporated by reference herein in their entirety. For the purposes of the invention, a polyvalent metal complex compound is one of a number of types of metal complex compounds, usually made by the addition of organic or inorganic atoms to inorganic compounds which contain the metal atom. Such compounds are essentially compounds to which atoms or groups are added beyond the number possible of explanation on the basis of electrovalent linkages, or the usual covalent linkages, wherein each of the two atoms linked donate one electron to form the duplet.

Examples of polyvalent metal complex compounds include, but are not limited to, ammonium zirconium carbonate $NH_4ZnCO_3$; potassium zirconium carbonate $KZnCO_3$; ammonium heptafluoro zirconate $(NH_4)_3$ $[ZrF_7]$; potassium tetracyano zincate $K_2$ $[Zn(CN)_4]$; sodium tetrahydroxo zincate $Na_2$ $(Zn(OH)_4]$; sodium tetrahydroxo aluminate Na $[Al(OH)_4]$; potassium trioxalato aluminate $K_3$ $[Al(C_20_4)_3]$; hexamine chromium chloride $[Cr(NH_3)_6]$ $Cl_3$ —$H_2O$; pentamine chloro chromium chloride $[Cr(NH_3)_3$—$Cl]$ $Cl_2$; hexamine nickel chloride $[Ni(NH_3)_6]$ $Cl_2$; tetramine dinitro cobalt nitrate $[Co(NH_3)_4(NO_2)_2]$ $(NO_3)_3$; hexamine cobalt chloride $[Co(NH_3)_6]$ $Cl_3$; hexamine cobalt iodide $[Co(NH_3)_6]$ $I_2$; hexamine cobalt nitrate $[Co(NH_3)_6]$ $(NO_3)_3$; hexamine cobalt sulfate $[Co(NH_3)_6]$ $SO_4$; hexamine cobalt bromide $[Co(NH_3)_6]$ $Br_2$; hexamine nickel bromide $[Ni(NH_3)_6]$ $Br_2$; hexamine nickel chlorate $[Ni(NH_3)_6]$ $(NO_3)_2$; hexamine nickel iodide $[Ni(NH_3)_6]$ $I_2$; hexamine nickel nitrate $[Ni(NH_3)_6]$ $(NO_3)_2$; tetramine zinc carbonate $[Zn(NH_3)_4]$ $CO_3$; tetramine zinc sulfate $[Zn(NH_3)_4]$ $SO_4$; tetramine zinc nitrate $[Zn(NH_3)_4]$ $(NO_3)_2$; diamine zinc chloride $[Zn(NH_3)_2]$ $Cl_2$; tetramine zinc chloride $[Zn(NH_3)_4]$ $Cl_2$; diamine copper acetate $[Cu(NH_3)_2]$ $(C_2H_3O_2)_2$; tetramine copper sulfate $[Cu(NH_3)_4]$ $SO_4$ -$H_2O$; tetramine copper hydroxide $[Cu(NH_3)_4]$ $(OH)_2$; ammonium tetra thiocyanato diamine chromate $NH_4$ $[Cr(NCS)_4(NH_3)_2]$ —$H_2O$; hexamine chromium chloride $[Cr(NH_3)_6]\ Cl_3$ —$H_2O$; and chloropentamine chromium chloride $[Cr(NH_3)_5$—$Cl]\ Cl_2$. Alloys thereof may also be employed. Preferred polyvalent metal complex compounds are ammonium zirconium carbonate and potassium zirconium caronate. The polyvalent metal complex compound is preferably used in the resin in an amount ranging from about 0.1 to about 15 weight percent based on the total weight of the monomers, more preferably from about 0.1 to about 7 weight percent, and most preferably from about 0.5 to about 5 weight percent.

The coating composition also may includes a number of other components such as, but not limited to, fillers, surfactants, biocides, thickeners, and other materials. Filler materials which may be used in the coating composition are known in the art and include, as an example, those described in U.S. Pat. No. 4,857,566 to Helbling, the disclosure of which is incorporated by reference in its entirety herein. Such fillers may be selected from metals in powder or filament form, and non-metals such as carbon, silicates, asbestos, titanium dioxide, zinc oxide, calcium carbonate, zinc sulfide, potassium titanate, glass flakes, clays, kaolin, and glass fibers. Metal salts of borate, carbonate, phosphate, or sulfate of aluminum, barium, magnesium, or zinc may be used. Metal salt hydrates may be used such as, for example, alumina trihydrate. The fillers are typically present in an amount ranging from about 10 to about 600 percent based on the total weight of the monomers. A preferred filler material is calcium carbonate.

Conventional surfactants can also be employed in the coating composition. Various anionic or nonionic surfactants may be employed for the purposes of the invention. Polymerizable surfactants that can be incorporated into the polymer also can be used. Nonionic surfactants can include suitable alkyl esters, alkyl phenyl ethers, and alkyl ethers of polyethylene glycol. Exemplary nonionic surfactants are selected from the family of alkylphenoxypoly(ethyleneoxy) ethanols where the alkyl group typically varies from $C_7$–$C_{18}$ and the ethylene oxide units vary from 4–100 moles. Various preferred surfactants in this class include the ethoxylated octyl and nonyl phenols, and in particular ethoxylated nonyl phenols with a hydrophobic/lipophilic balance (HLB) of 15–19. Anionic surfactants are preferred for the purposes of the invention and can be selected, for example, from the broad class of sulfonates, sulfates, ethersulfates, sulfosuccinates, diphenyloxide disulfonates, and the like, and are readily apparent to anyone skilled in the art. More particularly, the anionic surfactants can include a salt of an alcohol sulfate (e.g., sodium lauryl sulfate); a salt of an alkylbenzenesulfonic acid (e.g., sodium dodecylbenzenesulfonate); and a sulfonic acid salt of an aliphatic carboxylic acid ester (e.g., sodium dioctylsulfosuccinate). A preferred surfactant content in the coating composition ranges from about 0.1 to about 10 weight percent based on the total weight of the monomers, and more preferably from about 0.5 to about 5 weight percent.

Biocides which can be used in the coating composition are well known and include, for example, components such as Proxel GXL™ sold by Seneca Company of Wilmington, Del.; Tektamer 38 AD™ sold by Calgon Corporation of Pittsburgh, Pen.; Kathon LX™ sold by Rolm and Haas Corporation of Philadelphia, Pen.; and Nalco 5782™ and Nalco 5793™ sold by Nalco Chemical Corporation of Sugarland, Tex. The biocide is preferably used in an amount, based on the total weight of the compound, ranging from about 0.01 to about 0.1 weight percent.

The coating composition can include crosslinking agents and additives to improve various physical and mechanical properties of the polymer, the selection of which will be readily apparent to one skilled in the art. Exemplary crosslinking agents include vinylic compounds (e.g. divinyl benzene); allyllic compounds (e.g., allyl methacrylate, diallyl maleate); multifunctional acrylates (e.g., di, tri and tetrameth)acrylates); $C_1$–$C_4$ ethers of acrylamide-based monomers (e.g., isobutoxy methacrylamide),acrylamido glycolic acid and its esters, and alkyl acrylamido glycolate alkyl ethers (e.g., methylacrylamido glycolate methyl ether). The crosslinking agents can be included in amounts preferably from about 0.1 to about 5 percent by weight. Additional monomers can be included to improve specific properties such as solvent resistance (e.g., nitrile-containing monomers such as acrylonitrile and methacrylonitrile) and adhesion and strength (e.g., use of acrylamide or methacrylamide). The polymer can also include an antioxidant. These compounds retard oxidation by atmospheric oxygen at moderate temperature. Antioxidants tend to reduce yellowing and oxidative degradation due to thermal or prolonged aging. Antioxidants are typically based on aromatic amines (e.g., N-phenyl-N'-(1,3-dimethyl-butyl)-p-phenylene diamine) or hindred phenols (e.g. 4,4'-butylidene bis(6-tert butyl m-cresol). Phenolic antioxidants are preferred due to their reduced tendency towards discoloration. Thickeners may also be used in the coating composition and include, for example, sodium polyacrylate, cellulosics, acid latex thickeners, and mixtures thereof.

Other additives include other natural and synthetic binders, fixing agents, surface-active compounds, wetting agents, plasticizers (e.g., diisodecyl phthalate), softeners, foam-inhibiting agents, froth aids, other crosslinking agents (e.g., melamine formaldehyde resin), flame retardants, catalysts (e.g., diammonium phosphate or ammonium sulfate), dispersing agents, etc., the selection of which will be readily apparent to one skilled in the art.

In a second embodiment, the resin used in the coating composition may be one which does not contain aryl vinyl monomers. Such coatings are described in U.S. Pat. No. 5,505,999 to Krishnan et al., the disclosure of which is incorporated herein by reference. As described therein, a resin for use in a coating composition typically includes a non-aromatic unsaturated mono- or dicarboxylic ester monomer and an aliphatic conjugated diene monomer. Any of the monomers described herein may be used in the above resin. A preferred non-aromatic unsaturated mono- or dicarboxylic ester monomer is methyl methacrylate, and a preferred aliphatic conjugated diene monomer is 1,3-butadiene. The non-aromatic unsaturated mono- or dicarboxylic ester monomer is preferably used in an amount ranging from about 10 to about 90 percent by weight based on the total monomer weight, more preferably from about 30 to about 80 percent by weight, and most preferably from about 50 to about 70 percent by weight. The aliphatic conjugated diene monomer is preferably used in an amount ranging from about 10 to about 90 percent by weight based on the total monomer weight, more preferably from about 20 to about 70 percent by weight, and most preferably from about 30 to about 50 percent by weight. With the exception of aryl vinyl monomers, the coating composition may contain, but is not limited to, any of the additional monomers, additives, and other materials which are disclosed herein.

The textile substrate is typically coated with the coating by impregnating, padding or otherwise applying the coating to a surface of the textile substrate followed by heating the substrate to dry the coating. For purposes of this invention, the term "textile substrate" relates to a fiber, web, yarn, thread, sliver, woven fabric, knitted fabric, non-woven fabric, upholstery fabric, tufted carpet, pile carpet, etc. formed from natural textile substrate and/or synthetic fibers. A particularly suitable textile substrate is a tufted carpet. Tufted carpet typically comprises a primary backing with a front face and a rear face. Pile yarns extend through the front face of the primary backing. The pile yarns have portions extending through the primary baking which can be cut to form tufts or can be looped to form a loop pile. The pile yarns are bonded to the primary backing using the coating composition of the present invention, often referred to as a "tuft-lock" coating. The tufted carpet can be a unitary carpet or can include a secondary backing bonded to the primary backing. The secondary backing can be formed from natural fibers (e.g., jute), or synthetic fibers (e.g., polypropylene), and can be woven or non-woven materials. The secondary backing can also be a foam composition comprised of urethane polymers. The secondary backing can be bonded to the primary backing using the thermoplastic adhesive properties of the coating composition.

Other suitable textile substrates are needled non-woven fabrics formed from various natural and synthetic fibers such as described in U.S. Pat. No. 4,673,616 to Goodwin, the disclosure of which is incorporated herein by reference. The polymeric coating can be used to stiffen or rigidify the needled non-woven fabric to permit the fabric to be formed into a three-dimensional shape (i.e., it is moldable).

The present invention and its advantages over the prior art will be more fully understood and appreciated from the illustrative examples which follow. It is to be understood that the examples are for the purpose of illustration and are not intended as being limiting upon the scope of the invention. A person skilled in the applicable arts will appreciate from these examples that this invention can be embodied in many different forms other than as is specifically disclosed.

EXAMPLE

A coating composition was formulated as follows. A styrene-butadiene polymer resin was dispersed in the aqueous medium, with calcium carbonate filler, biocide, surfactant, wax, ammonium zirconium carbonate, and synthetic thickener being subsequently added. The calcium carbonate filler was loaded in a 600 parts amount in order to attempt to make the latex more hydrophilic. The coating composition had the following ingredients and corresponding amounts (parts):

| Ingredient | Dry | Wet | Wet × 61 |
|---|---|---|---|
| water | — | 51.43 | 3,137 |
| latex | 100.00 | 188.68 | 11,509 |
| $CaCO_3$ | 600.00 | 600.00 | 36,600 |
| wax | 16.50 | 34.02 | 2,075 |
| Proxel ™ (biocide) | 0.05 | 0.25 | 15 |
| Tektamer ™ (biocide) | 0.04 | 0.16 | 10 |
| surfactant | 1.90 | 6.03 | 368 |
| thickener | 1.00 | 7.69 | 469 |
| totals | 719.49 | 888.26 | 54,183 |

TS 81.0%
Viscosity 15,000 cps #5 spindle at 20 rpm

The coating composition was then coated on a sample piece of carpet. A piece of blotting paper was then placed underneath the carpet. 20 ml of cherry Kool-Aid® was poured onto the face of the carpet sample through a 1.5 inch diameter circular cylinder to create a circular spot. The carpet sample was undisturbed for 24 hours. The filter paper and the back of the carpet sample were then inspected for stains. No visible stains were apparent on the filter paper and only a slight discoloration was observed on the back of the carpet sample. Thus, the coating composition was deemed to be acceptable.

Comparative Example

A procedure similar to that described in the above example was carried out except a 20 ml sample of hot coffee was poured onto the face of a carpet sample. No visible stains were apparent on the filter paper and only a slight discoloration was observed on the back of the carpet sample. Thus, the coating composition was deemed to be acceptable. In comparison, the latex described in Example 1 was employed with 2 parts dry basis, 4.5 parts wet basis of fluorocarbon which replaced the wax component. A carpet sample containing the fluorocarbon-containing latex was then tested with hot coffee similar to above. Visible stains were apparent on the filter paper and the back of the carpet sample was observed to be discolored.

Many modifications and other embodiments of the invention will come to mind in one skilled in the art to which this invention pertains having the benefit of the teachings presented in the foregoing descriptions. Therefore, it is to be understood that the invention is not to be limited to the specific embodiments disclosed. Although specific terms are employed, they are used in a generic and descriptive sense only and not for purposes of limitation, and that modifications and embodiments are intended to be included within the scope of the appended claims.

That which is claimed:

1. An pile carpet comprising:

a primary backing having a front face and a rear face;

pile yarns extending through the front face of said primary backing to form pile tufts, and having portions extending through said primary backing;

a tuft-lock coating having improved water resistance carried by the rear face of said primary backing and securing said pile yarns to said primary backing, the tuft-lock coating comprising a resin dispersed in an aqueous medium, a wax, and a polyvalent metal complex compound.

2. The pile carpet according to claim 1, wherein the wax is selected from the group consisting essentially of natural waxes, synthetic waxes, and mixtures thereof.

3. The pile carpet according to claim 1, wherein the polyvalent metal complex compound is selected from the group consisting essentially of ammonium zirconium carbonate, potassium zirconium carbonate, and alloys thereof.

4. The pile carpet according to claim 1, wherein the resin comprises a copolymer formed from an aryl vinyl monomer and an aliphatic conjugated diene monomer.

5. The pile carpet according to claim 4, wherein the aryl vinyl monomer is styrene and the aliphatic conjugated diene monomer is 1,3-butadiene.

6. The pile carpet according to claim 1, wherein said tuft lock coating comprises of from about 5 to about 15 percent by weight of the wax and of from about 0.5 to about 5 percent by weight of the polyvalent metal complex compound.

7. The pile carpet according to claim 1, wherein the coating composition comprises a biocide.

8. The pile carpet according to claim 1, wherein the coating composition comprises a filler.

9. The pile carpet according to claim 1, wherein the resin comprises a polymer comprising a non-aromatic unsaturated mono- or dicarboxylic ester monomer and an aliphatic conjugated diene monomer.

10. The pile carpet according to claim 9, wherein the non-aromatic unsaturated mono- or dicarboxylic ester monomer is selected from the group consisting of methyl acrylate, methyl methacrylate, ethyl acrylate, ethyl methacrylate, butyl acrylate, butyl methacrylate, 2-ethylhexyl acrylate, glycidyl acrylate, glycidyl methacrylate, dimethyl fumarate, diethyl fumarate, dimethyl maleate, diethyl maleate, dimethyl itaconate, diethyl itaconate, hydroxyethyl acrylate, hydroxyethyl methacrylate, hydroxypropyl acrylate, hydroxypropyl methacrylate, hydroxybutyl acrylate, hydroxybutyl methacrylate, 3 -chloro-2-hydroxybutyl methacrylate, di(ethylene glycol) maleate, di(ethylene glycol)itaconate, bis(2-hydroxyethyl) maleate, 2-hydroxyethyl methyl fumarate, t-butylamino ethyl methacrylate and dimethylamino ethyl methacrylate monomers and blends and comonomers thereof.

11. The pile carpet according to claim 9, wherein the aliphatic conjugated diene monomer is a $C_4$ to $C_9$ diene monomer.

12. An article of manufacture comprising a textile substrate and a coating carried by said textile substrate, said coating comprising a resin dispersed in an aqueous medium, a wax, and a polyvalent metal complex compound.

13. The article of manufacture according to claim 12, wherein the wax is selected from the group consisting essentially of natural waxes, synthetic waxes, and mixtures thereof.

14. The article of manufacture according to claim 12, wherein the polyvalent metal complex compound is selected from the group consisting essentially of ammonium zirconium carbonate, potassium zirconium carbonate, and mixtures thereof.

15. The article of manufacture according to claim 12, wherein the resin comprises a copolymer formed from an aryl vinyl monomer and an aliphatic conjugated diene monomer.

16. The article of manufacture according to claim 15, wherein the aryl vinyl monomer is styrene and the aliphatic conjugated diene monomer is 1,3-butadiene.

17. The article of manufacture according to claim 12, wherein said coating composition comprises of from about 5 to about 15 percent by weight of the wax and of from about 0.5 to about 5 percent by weight of the polyvalent metal complex compound.

18. The article of manufacture according to claim 12, wherein the resin comprises a polymer comprising a non-aromatic unsaturated mono- or dicarboxylic ester monomer and an aliphatic conjugated diene monomer.

19. The article of manufacture according to claim 18, wherein the non-aromatic mono- or dicarboxylic ester monomer is selected from the group consisting of methyl acrylate, methyl methacrylate, ethyl acrylate, ethyl methacrylate, butyl acrylate, butyl methacrylate, 2-ethylhexyl acrylate, glycidyl acrylate, glycidyl methacrylate, dimethyl fumarate, diethyl fumarate, dimethyl maleate, diethyl maleate, dimethyl itaconate, diethyl itaconate, hydroxyethyl acrylate, hydroxyethyl methacrylate, hydroxypropyl acrylate, hydroxypropyl methacrylate, hydroxybutyl acrylate, hydroxybutyl methacrylate, 3 -chloro-2-hydroxybutyl methacrylate, di(ethylene glycol) maleate, di(ethylene glycol)itaconate, bis(2-hydroxyethyl) maleate, 2-hydroxyethyl methyl fumarate, t-butylamino ethyl methacrylate and dimethylamino ethyl methacrylate monomers and blends and comonomers thereof.

20. The article of manufacture according to claim 18, wherein the aliphatic conjugated diene monomer is a $C_4$ to $C_9$ diene monomer.

21. The article of manufacture according to claim 12, wherein the coating composition comprises a biocide.

22. The article of manufacture according to claim 12, wherein the coating composition comprises a filler.

23. A textile coating composition comprising a resin dispersed in an aqueous medium, a wax, and a polyvalent metal complex compound.

24. The textile coating composition according to claim 23, wherein the wax is selected from the group consisting essentially of natural waxes, synthetic waxes, and mixtures thereof.

25. The textile coating composition according to claim 23, wherein the polyvalent metal complex compound is selected from the group consisting essentially of ammonium zirconium carbonate, potassium zirconium carbonate, and mixtures thereof.

26. The textile coating composition according to claim 23, wherein the resin comprises a copolymer formed from an aryl vinyl monomer and an aliphatic conjugated diene monomer.

27. The textile coating composition according to claim 26, wherein the aryl vinyl monomer is styrene and the aliphatic conjugated diene monomer is 1,3-butadiene.

28. The textile coating composition according to claim 23, wherein said coating composition comprises of from about 5 to about 15 percent by weight of the wax and of from about 0.5 to about 5 percent by weight of the polyvalent metal complex compound.

29. The textile coating composition according to claim 23, wherein the resin is formed from a polymer comprising a non-aromatic unsaturated mono- or dicarboxylic ester monomer and an aliphatic conjugated diene monomer.

30. The textile coating composition according to claim 29, wherein the non-aromatic unsaturated mono- or dicarboxylic ester monomer is selected from the group consisting of methyl acrylate, methyl methacrylate, ethyl acrylate, ethyl methacrylate, butyl acrylate, butyl methacrylate, 2-ethylhexyl acrylate, glycidyl acrylate, glycidyl methacrylate, dimethyl fumarate, diethyl fumarate, dimethyl maleate, diethyl maleate, dimethyl itaconate, diethyl itaconate, hydroxyethyl acrylate, hydroxyethyl methacrylate, hydroxypropyl acrylate, hydroxypropyl methacrylate, hydroxybutyl acrylate, hydroxybutyl methacrylate, 3-chloro-2-hydroxybutyl methacrylate, di(ethylene glycol) maleate, di(ethylene glycol)itaconate, bis(2-hydroxyethyl) maleate, 2-hydroxyethyl methyl fumarate, t-butylamino ethyl methacrylate and dimethylamino ethyl methacrylate monomers and blends and comonomers thereof.

31. The textile coating composition according to claim 29, wherein the aliphatic conjugated diene monomer is a $C_4$ to $C_9$ diene monomer.

32. The textile coating composition according to claim 23, wherein said coating composition comprises a biocide.

33. The textile coating composition according to claim 23, wherein said coating composition comprises a filler.

34. A method of preparing a textile substrate, said method comprising:

applying to a surface of the textile substrate a coating composition, the coating composition comprising a resin dispersed in an aqueous medium, a wax, and a polyvalent metal complex compound; and heating the surface of the textile substrate to dry the coating composition.

35. The method according to claim 34, wherein the wax is selected from the group consisting essentially of natural waxes, synthetic waxes, and mixtures thereof.

36. The method according to claim 34, wherein the polyvalent metal complex compound is selected from the group consisting essentially of ammonium zirconium carbonate, potassium zirconium carbonate, and mixtures thereof.

37. The method according to claim 34, wherein the resin comprises a copolymer formed from an aryl vinyl monomer and an aliphatic conjugated diene monomer.

38. The method according to claim 37, wherein the aryl vinyl monomer is styrene and the aliphatic conjugated diene monomer is 1,3-butadiene.

39. The method according to claim 34, wherein the coating composition comprises of from about 5 to about 15 percent by weight of the wax and of from about 0.5 to about 5 percent by weight of the polyvalent metal complex compound.

40. The method according to claim 34, wherein the resin is formed from a polymer comprising a non-aromatic unsaturated mono- or dicarboxylic ester monomer and an aliphatic conjugated diene monomer.

41. The method according to claim 40, wherein the non-aromatic unsaturated mono- or dicarboxylic ester monomer is selected from the group consisting of methyl acrylate, methyl methacrylate, ethyl acrylate, ethyl methacrylate, butyl acrylate, butyl methacrylate, 2-ethylhexyl acrylate, glycidyl acrylate, glycidyl methacrylate, dimethyl fumarate, diethyl fumarate, dimethyl maleate, diethyl maleate, dimethyl itaconate, diethyl itaconate, hydroxyethyl acrylate, hydroxyethyl methacrylate, hydroxypropyl acrylate, hydroxypropyl methacrylate, hydroxybutyl acrylate, hydroxybutyl methacrylate, 3-chloro-2-hydroxybutyl methacrylate, di(ethylene glycol) maleate, di(ethylene glycol)itaconate, bis(2-hydroxyethyl) maleate, 2-hydroxyethyl methyl fumarate, t-butylamino ethyl methacrylate and dimethylamino ethyl methacrylate monomers and blends and comonomers thereof.

42. The method according to claim 40, wherein the aliphatic conjugated diene monomer is a $C_4$ to $C_9$ diene monomer.

* * * * *